US009325075B1

(12) United States Patent
Lam

(10) Patent No.: US 9,325,075 B1
(45) Date of Patent: Apr. 26, 2016

(54) ANTENNAE FORMED USING INTEGRATED SUBARRAYS

(75) Inventor: Lawrence K. Lam, San Jose, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 162 days.

(21) Appl. No.: 13/481,663

(22) Filed: May 25, 2012

(51) Int. Cl.
*H01Q 13/10* (2006.01)

(52) U.S. Cl.
CPC ..... *H01Q 13/10* (2013.01)

(58) Field of Classification Search
CPC ..... H01Q 13/10
USPC ..... 343/767, 770
See application file for complete search history.

(56) References Cited

U.S. PATENT DOCUMENTS

| | | | | |
|---|---|---|---|---|
| 3,836,976 | A * | 9/1974 | Monser et al. | 343/795 |
| 4,980,692 | A | 12/1990 | Rudish et al. | |
| 5,309,165 | A * | 5/1994 | Segal et al. | 343/770 |
| 5,592,178 | A | 1/1997 | Chang et al. | |
| 5,905,466 | A | 5/1999 | Jha | |
| 5,956,234 | A | 9/1999 | Mueller | |
| 6,822,609 | B2 * | 11/2004 | Mendolia et al. | 343/700 MS |
| 7,548,212 | B2 | 6/2009 | Chekroun et al. | |
| 7,764,236 | B2 * | 7/2010 | Hill et al. | 343/702 |
| 8,068,068 | B2 * | 11/2011 | Kish et al. | 343/876 |
| 8,138,985 | B2 * | 3/2012 | Cooper | 343/770 |
| 8,466,846 | B1 * | 6/2013 | Elsallal et al. | 343/770 |
| 2008/0303716 | A1 * | 12/2008 | Gallivan et al. | 342/368 |
| 2010/0315303 | A1 * | 12/2010 | Kearney et al. | 343/767 |

OTHER PUBLICATIONS

Kindt, R.W. et al. "Ultrawideband All-Metal Flared-Notch Array Radiator", IEEE Trans. on Antennas and Propagation, vol. 58, issue 11. Nov. 2010, pp. 3568-3575.
Otter, W. J., et al. "Multi-Octave BAVA Radiating Elements for use in Modular Phased Array Antennas," 3rd European Conference on Antennas and Propagation EuCAP, pp. 1324-1328, Mar. 2009.
Rob A. Lewis, "Wideband Antenna Technology in Military Applications," International Workshop on Antenna Technology (iWAT), Mar. 2010.
Z. Y. Zhang, et al., "Wideband Unidirectional Patch Antenna With ⌈ Shaped Strip Feed", Electronics Letters, Jan. 7, 2010, vol. 46, No. 1.
"Ultralam® 3000 Liquid Crystalline Polymer Circuit Material", Rogers Corporation, Advanced Circuit Materials Division, Data Sheet RF 1.3000, Publication No. 92-125, May 10, 2011.
"Ultralam® 3908 Bondply, ULTRALAM 3000 Series, Liquid Crystalline Polymer Circuit Materials", Rogers Corporation, Advanced Circuit Materials Division, Data Sheet RF 1.3908, Publication No. 92-126, Nov. 2006.
"RO4000® Series High Frequency Circuit Materials", Rogers Corporation, Advanced Circuit Materials Division, Data Sheet, Publication No. 92-004, May 2010.
"Flex Circuit Design Guide", Technical Specification FC302, MINCO 2006, pp. 1-29.

* cited by examiner

*Primary Examiner* — Dameon E Levi
*Assistant Examiner* — Hasan Islam
(74) *Attorney, Agent, or Firm* — McDermott Will & Emery LLP

(57) ABSTRACT

An antenna subarray is disclosed that includes a main board comprising a first substrate, a patterned conductive layer coupled to the first substrate, and a first antenna element coupled to the first substrate. The subarray also includes at least one ancillary board comprising a second substrate coupled to and extending outward from the first substrate and a second antenna element coupled to the second substrate and coupled through a soldered connection to the patterned conductive layer.

18 Claims, 12 Drawing Sheets

ANTENNAE FORMED USING INTEGRATED SUBARRAYS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of Invention

The present disclosure generally relates to antenna arrays and, in particular, antenna composed of elements fabricated using surface mount technology.

2. Description of the Related Art

Conventional designs for wideband Electronically Scanned Arrays (ESAs) are heavy and costly because of the number of connectors and cables utilized to assemble the antenna elements into an integrated array. Traditional dual-polarization wideband ESA designs are based on Vivaldi antenna element constructed in an egg-crate configuration. These designs are complex to manufacture and include a connector for each antenna element.

Conventional ESAs generally have a planar configuration and do not provide field of view (FOV) with a significant fraction of the maximum gain available at low elevation angles. This is a significant disadvantage for a ground-based system communicating with aircraft flying overhead or an orbital system communicating with ground-based systems. For example, a conventional ESA pointed straight up, i.e. at a 90° elevation angle, requires an increase in signal strength of 6 dB to reach an aircraft at an elevation of 30° compared to the signal strength required to reach the same aircraft when directly overhead.

SUMMARY

There is a need to provide an antenna system that is simple and easy to construct with a higher gain at low elevation angles than the gain provided at a 90° elevation.

In certain embodiments, an antenna subarray is disclosed that includes a main board comprising a first substrate, a patterned conductive layer coupled to the first substrate, and a first antenna element coupled to the first substrate. The subarray also includes at least one ancillary board comprising a second substrate coupled to and extending outward from the first substrate and a second antenna element coupled to the second substrate and coupled through a soldered connection to the patterned conductive layer.

In certain embodiments, a method of forming an antenna subarray is disclosed. The method includes the step of soldering a first patterned conductive layer that is formed on a first printed circuit board assembly (PCBA) and electrically coupled to an antenna element also formed on the first PCBA to a second patterned conductive layer that is formed on a second PCBA and electrically coupled to one of a signal source or a ground.

In certain embodiments, an antenna subarray is disclosed that includes a first PCBA comprising a first nonconductive substrate, a signal circuit formed on the first substrate, a ground formed on the first substrate, a plurality of first radiating elements formed on the first substrate and electrically coupled to the signal circuit. and a plurality of second radiating elements formed on the first substrate and electrically coupled to the ground. The subarray also includes a plurality of second PCBAs each comprising a second nonconductive substrate coupled to and extending outward from the first substrate, a plurality of third radiating elements formed on the second substrate and electrically coupled by soldering to the signal circuit, and a plurality of fourth radiating elements formed on the second substrate and electrically coupled by soldering to the ground.

In certain embodiments, an antenna array is disclosed that includes a plurality of antenna subarrays each comprising a first PCBA that includes a first nonconductive substrate, a signal circuit formed on the first substrate, a ground formed on the first substrate, a plurality of first radiating elements formed on the first substrate and electrically coupled to the signal circuit, and a plurality of second radiating elements formed on the first substrate and electrically coupled to the ground. The subarray also includes a plurality of second PCBAs each comprising a second nonconductive substrate coupled to and extending outward from the first substrate, a plurality of third radiating elements formed on the second substrate and electrically coupled by soldering to the signal circuit, and a plurality of fourth radiating elements formed on the second substrate and electrically coupled by soldering to the ground.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

The method and system disclosed herein are presented in terms of a linear dual polarized antenna subarray module that can be used to provide antenna arrays in multiple configurations. The disclosed embodiment of the subarray provides a basis for explaining the disclosed construction techniques and the advantages thereof. It will be obvious to one of skill in the art that the same concepts can be applied to other types of antenna subassemblies. Nothing in this disclosure should be interpreted, unless specifically stated as such, to limit the application of any method or system disclosed herein to a linear subarray or a dual polarization subarray.

In the following detailed description, numerous specific details are set forth to provide a full understanding of the present disclosure. It will be apparent, however, to one ordinarily skilled in the art that embodiments of the present disclosure may be practiced without some of the specific details. In other instances, well-known structures and techniques have not been shown in detail so as not to obscure the disclosure.

As used within this disclosure, the terms "printed circuit board assembly" and "PCBA" refer to a construct comprising one or more patterned layers comprising at least one of a conductive material and a semiconductive material and one or more separating layers comprising at least one of a dielectric material and a nonconductive material. When multiple patterned layers exist, conductive or semiconductive interconnections may be formed between the patterned layers through the intervening separating layers. Conventional PCBAs constructed with patterned metal layers, for example etched copper, separated by nonconductive substrates, for example FR4 glass-reinforced epoxy laminate, with discrete electronic devices coupled to one or more of the metal layers, for example by soldering, are included in the described constructs. These terms also include other types of multi-layer constructs formed by various other means, including for example a 3D printer that directly prints one or more of the various patterned and separating layers. Another example method of construction uses a laser cutter to produce patterns in the patterned layers and form interconnection holes through the separating layers. Another example of a suitable fabrication methodology includes the use of one or more of the deposition, doping, implantation, etching, and forming processes as typically used to create semiconductor devices on substrates such as silicon or sapphire wafers.

Figure 1A:
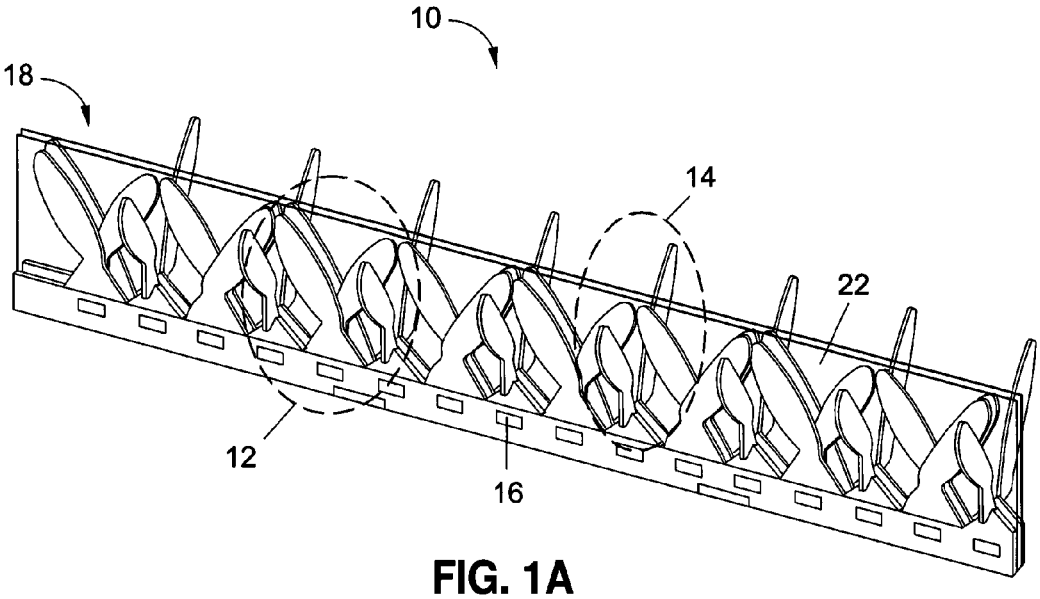
FIG. 1A is a perspective view of an exemplary antenna subarray showing a plurality of rabbit ear antenna elements according to certain aspects of the present disclosure.

FIG. 1A is a perspective view of an exemplary antenna subarray 10 showing a plurality of rabbit ear antenna radiating elements 12,14 according to certain aspects of the present disclosure. Antenna radiating elements 14 are mounted perpendicular to the main board 18 while antenna radiating elements 12 are formed on the surface or as interior layers of main board 18. The antenna radiating elements 12 and 14 cooperate to form functional antenna subassemblies as described with respect to FIG. 5A. The antenna subarray 10 also includes electronic components 16 mounted to the surface of main board 18. Electronic components 16 may include active or passive devices such as, for example, filters, amplifiers, phase shifters, and beam-forming networks. The substrate 22 of main board 18 is shown as partially transparent and the antenna radiating elements 14 are shown without a substrate to improve the clarity of the depiction of the arrangement of the cooperative antenna radiating elements 12, 14. The rabbit ear antenna radiating element is only one example of a suitable design for an antenna radiating element. Other embodiments are described in FIGS. 1C-1F.

Figure 1B:
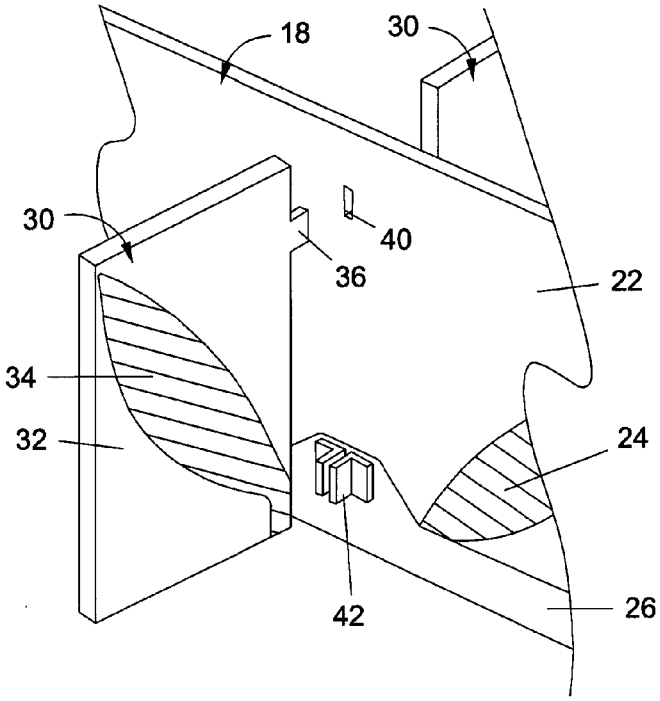
FIG. 1B depicts the construction of an exemplary embodiment of an antenna subarray utilizing ancillary boards attached to each side of the main board according to certain aspects of the present disclosure.

FIG. 1B depicts the construction of an exemplary embodiment of an antenna subarray 10 utilizing ancillary boards 30 attached to each side of the main board 18 according to certain aspects of the present disclosure. In this embodiment, the main board 18 is formed with antenna elements 24 and patterned conductive layers 26 formed on the substrate 22. Ancillary boards 30 each have a substrate 32 with antenna elements 34 formed on the surface or as interior layers of the substrate 32. Each ancillary board 30 also includes a tab 36 that couples with slot 40 of the main board 18 to provide alignment and structural support of the ancillary board 30. The surface antenna element 34 of the ancillary board 30 is connected to the patterned conductive layer 26 of the main board 18 in this embodiment by a conductive connection element 42 that is soldered to both the antenna element 34 and the patterned conductive layer 26.

Figure 1C:
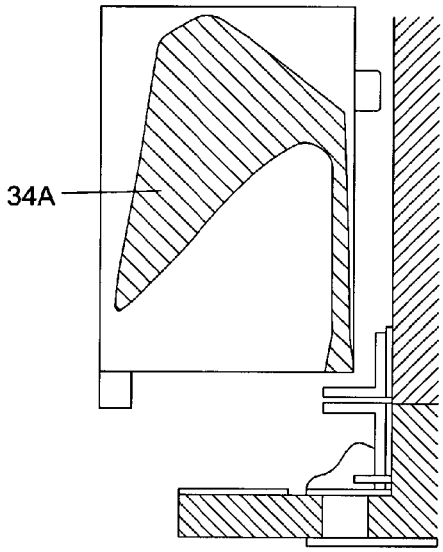
FIGS. 1C-1F depict other embodiments of the antenna radiating element according to certain aspects of the present disclosure.
Figure 1D:
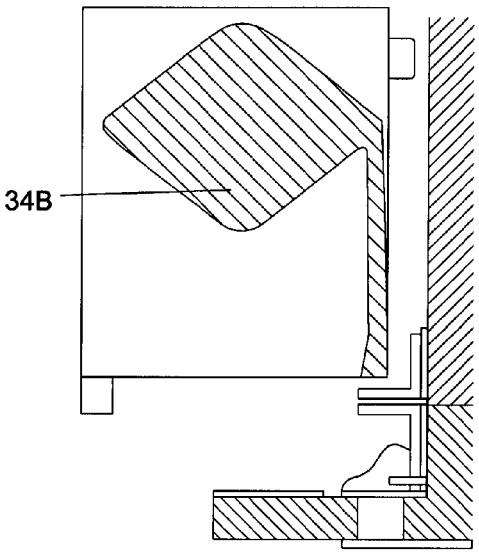
Figure 1E:
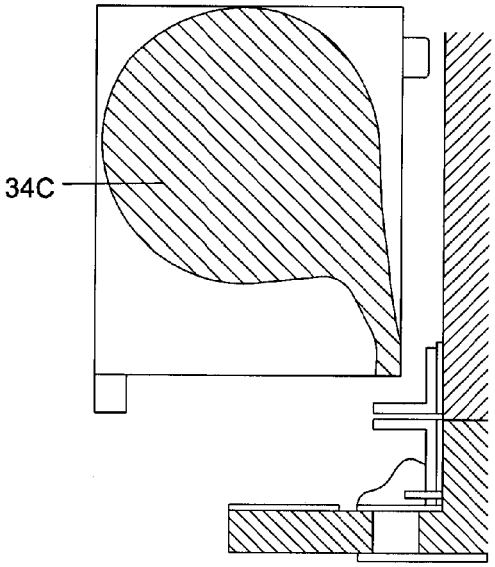
Figure 1F:
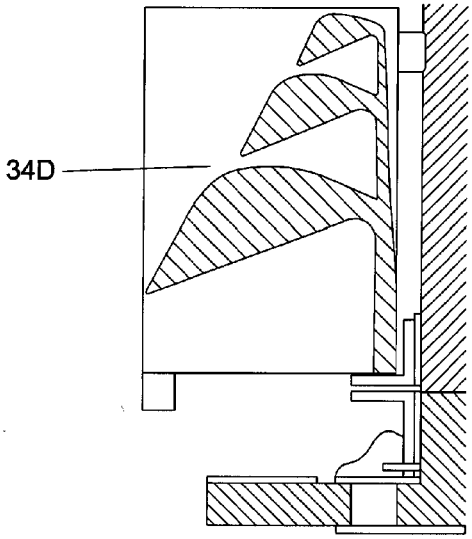

FIGS. 1C-1F depict other embodiments 34A-34D of the antenna radiating element according to certain aspects of the present disclosure. FIG. 1C depicts a "dog ear" embodiment 34A and FIG. 1D depicts a "bow tie" embodiment 34B. FIG. 1E depicts a "mouse ear" embodiment 34C and FIG. 1F depicts a "yagi tree" embodiment 34D. Any antenna element that functions efficiently as a radiating element in an array environment without requiring adjacent antenna radiating elements to be direct coupled may be substituted for the antenna radiating element 34 presented in this disclosure.

Figure 2:
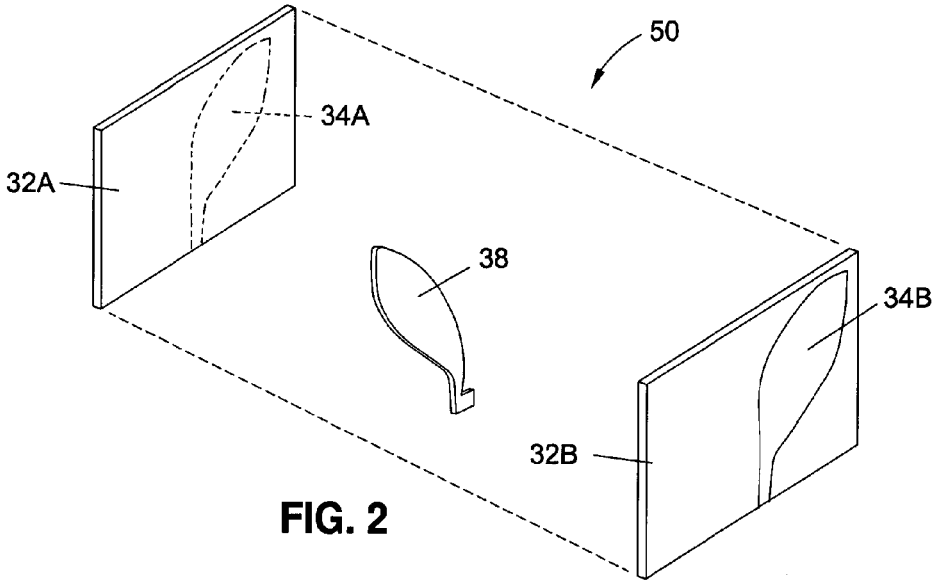
FIG. 2 is an exploded view of an exemplary ancillary board according to certain aspects of the present disclosure.

FIG. 2 is an exploded view of an exemplary ancillary board 50 according to certain aspects of the present disclosure. Ancillary board 50 replaces a pair of ancillary boards 30 that are disposed on opposite sides of main board 18 as shown in FIG. 1B. In this embodiment, two substrate layers 32A, 32B have antenna elements 34A and 34B formed on the surfaces of the respective substrates 32A, 32B. A formed metal antenna element 38, similar to a formed metal leadframe, similar to those commonly used in integrated circuit assemblies, is positioned between the two substrate layers 32. In certain embodiments, a portion of antenna element 38 is formed as a plated conductive layer on one of the substrates 34A, 34B. When assembled, these three antenna elements 34A, 34B, 38 will form a single polarization balanced antipodal Vivaldi antenna (BAVA) element.

Figure 3B:
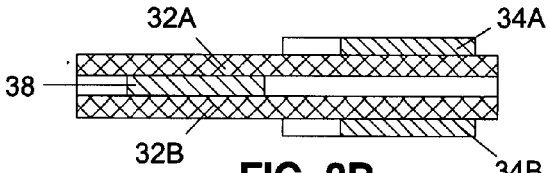
FIGS. 3A-3C depict various views of the ancillary board of FIG. 2 according to certain aspects of the present disclosure.
Figure 3A:
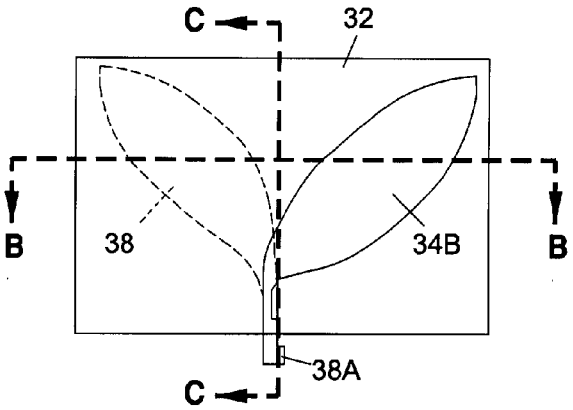
Figure 3C:
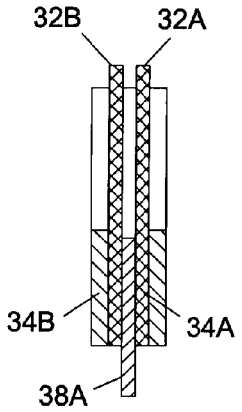

FIGS. 3A-3C depict various views of the ancillary board 50 of FIG. 2 according to certain aspects of the present disclosure. FIG. 3A is a front view of ancillary board 50 wherein it can be seen how the two antenna elements 34A, 34B coincide in profile while the formed metal antenna element 38 projects in the opposite direction with a tab 38A projecting below the substrates 32. While the antenna elements 34A, 34B, and 38 are shown here as 'rabbit ear' shapes, other antenna shapes such as "dog ear" or "yagi tree" or other planar shapes can used as well. The function of the tab 38A is discussed in greater detail with respect to FIG. 5B.

FIG. 3B is a cross section of the ancillary board 50 taken along the line B-B shown in FIG. 3A. It can be seen how the two layers of substrate 32 are formed around the formed metal antenna element 38 with antennal elements 34A, 34B formed on the surfaces of respective layers 32A, 32B. In certain embodiments, the substrates 32A, 32B are not completely planar, as shown in FIG. 3B, and conform around the antenna element 38.

FIG. 3C is a cross section of the ancillary board 50 taken along the line C-C of FIG. 3A. It can be seen how the two layers 32 are formed on each side of the formed metal antenna element 38 with antenna elements 34A, 34B formed on the surface of the respective layers 32A, 32B.

Figure 4:
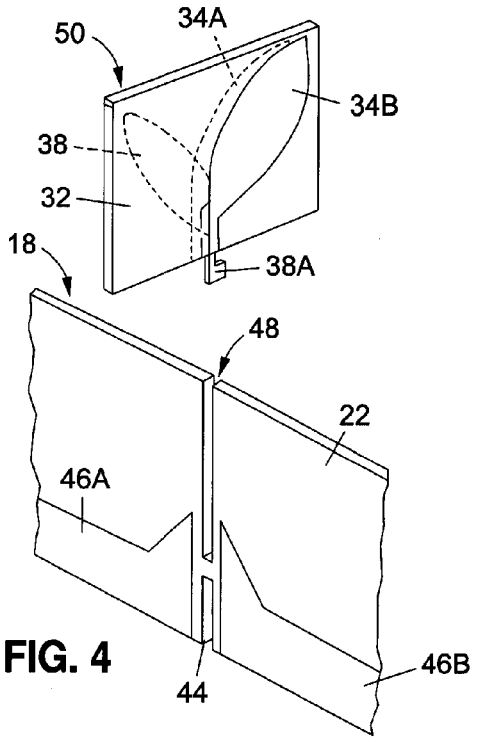
FIG. 4 is an exploded view of ancillary board with main board according to certain aspects of the present disclosure.

FIG. 4 is an exploded view of ancillary board 50 with main board 18 according to certain aspects of the present disclosure. A slot 48 has been cut through the substrate 22 of main board 18. In this embodiment, two patterned conductive layers 46A, 46B are formed on the surface of main board 18, each layer 46A, 46B having a portion that is adjacent to slot 48. A conductive microstrip 44 is formed beneath slot 48 and between the conductive layers 46A, 46B.

Figure 5A:
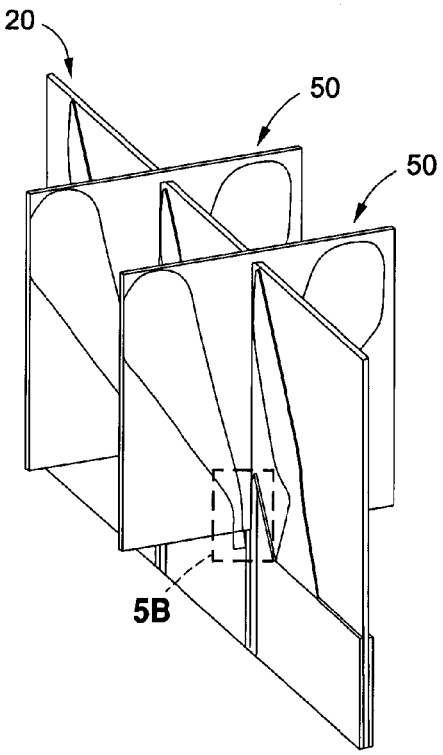
FIGS. 5A and 5B depict details of the assembly of ancillary board with the main board of FIG. 4 according to certain aspects of the present disclosure.
Figure 5B:
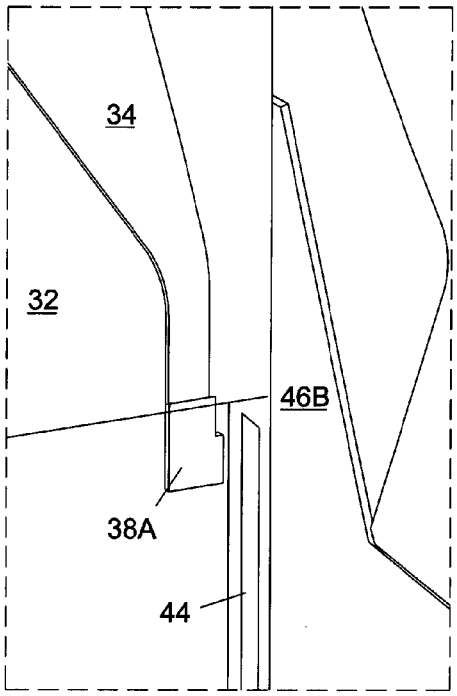

FIGS. 5A and 5B depict details of the assembly of ancillary board 50 with the main board 18 of FIG. 4 according to certain aspects of the present disclosure. It can be seen how the BAVA antenna element comprising the antenna elements 34A, 34B and 38 disposed on ancillary board 50 cooperate with antenna elements on the main board 18 to form an antenna array. The dash line box of FIG. 5A indicates the view shown in an enlarged form in FIG. 5B.

In certain embodiments, the antenna element 50 is designed as an electronic component and configured to be inserted into slot 48 as shown in FIG. 5B by an automated pick-and-place assembly machine, such as commonly used in conventional surface mount technology (SMT) manufacturing processes.

FIG. 5B depicts the details of interconnection of the ancillary board 50 with main board 18. Portions of the antenna elements 34A, 34B that are on the surface of the substrate 32 are disposed adjacent to the pattern conductive layer 46A, 46B. In certain embodiments, patterned conductive layers 46A, 46B are connected to a ground. A conductive connective element, such as connection element 42 from FIG. 1B, can be soldered across these two surface layers thereby connecting them. Tab 38A of the formed metal antenna element 38 of ancillary board 50 projects below the substrate 32 and is positioned adjacent to microstrip 44. In certain embodiments, microstrip 44 is connected to a signal source. Again, a connection element 42 can be soldered across these tab 38A and microstrip 44 thereby coupling the active elements of a transmitter or receiver circuit to the interior antenna element 38.

In conventional antenna arrays, connection of antenna elements is accomplished through dematable connectors. Replacement of dematable connectors with a soldered connection, such as discussed with respect to FIG. 5B, simplifies the assembly as standard reflow techniques may be used to complete the connection of multiple ancillary boards 50 to a main board 18. Use of a soldered connection in place of a dematable connector may also improve the performance and/or reliability of the antenna array.

Figure 6:
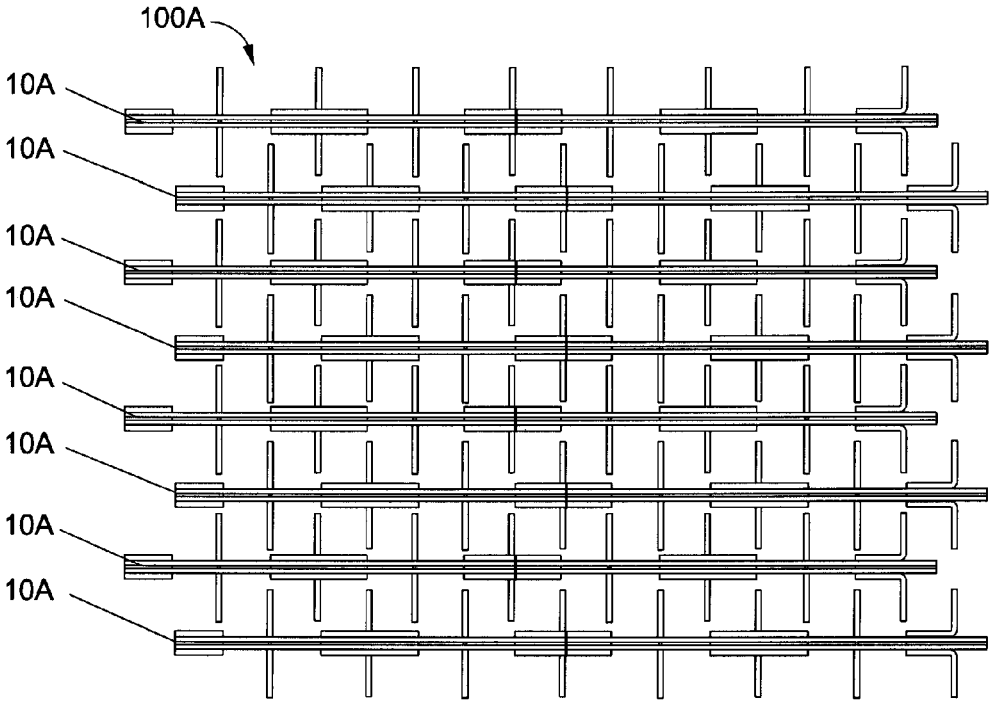
FIGS. 6 and 7 disclose two embodiments of antenna arrays according to certain aspects of the present disclosure.
Figure 7:
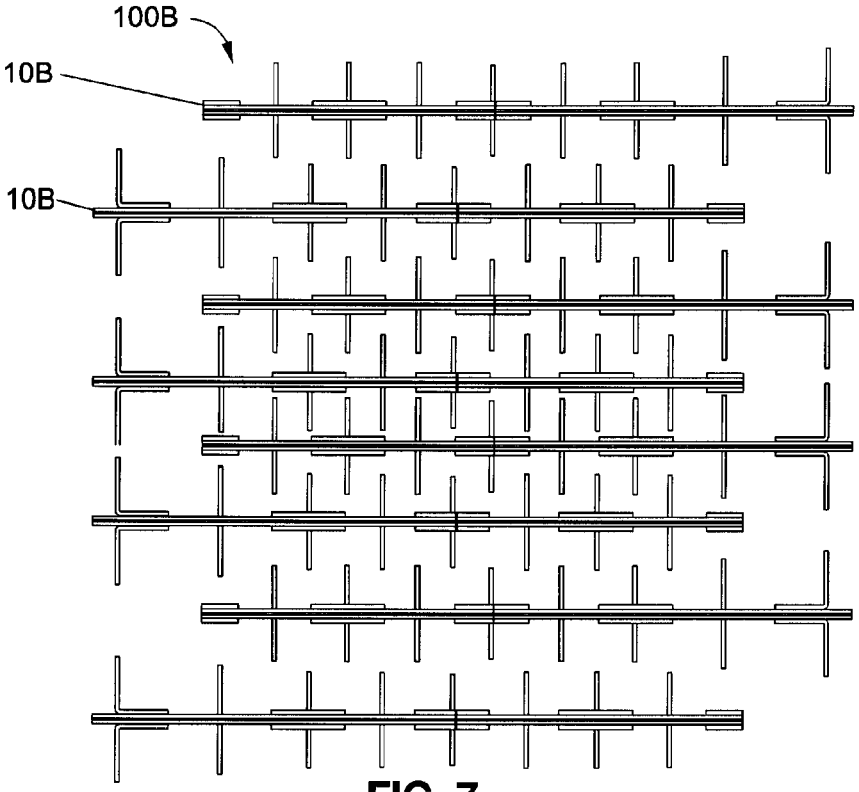

FIGS. 6 and 7 disclose two embodiments 100A and 100B of antenna arrays according to certain aspects of the present disclosure. FIG. 6 is a two dimensional planar array of subarrays 10A that each have a uniform selection of antenna elements at regular spacing. The subarrays 1 OA are arranged at uniform separations in a repeating pattern that is both scalable and easily configured. As the antenna elements on subarrays 10 are soldered, this improves the reliability of the overall system by elimination of mateable connectors. As each of the subarrays 1 OA may be separately connected to the drive circuits (not shown), the reduced number of overall connections may improve the reliability as well as simplifying construction of the array 100A.

FIG. 7 depicts an array 100B wherein each of the subarrays 10B employs a variety of antenna elements positioned at variable spacing along the subarrays 10B. In addition, the separation of the subarrays 10B with respect to each other is variable to provide a specific beam pattern and frequency range.

In certain embodiments, certain subarrays 10B of antenna elements have a polarization that is orthogonal to the polarization to another subarrays 10B within the same antenna array 100B. In certain embodiments, certain subarrays 10B of antenna elements have a different type of polarization than the polarization of other subarrays 10B within the same antenna 100B.

Figure 8:
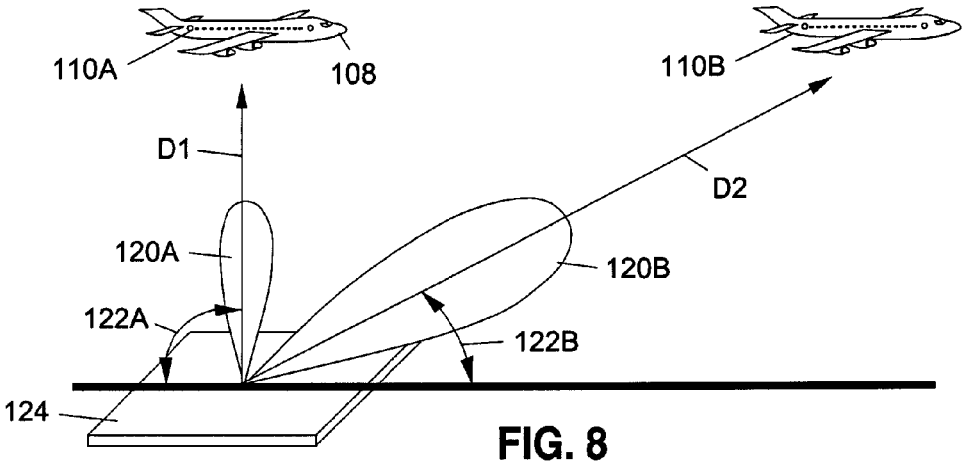
FIG. 8 depicts the beam patterns of a ground-based antenna array in communication with an aircraft according to certain aspects of the present disclosure.

FIG. 8 depicts the beam patterns 120A, 120B of a ground-based antenna array 100 in communication with an aircraft 108 according to certain aspects of the present disclosure. When the aircraft 108 is located at position 110A, it is directly over the antenna array 100 at a distance of D1. A beam pattern 120A oriented at elevation 122A equal to 90° from the horizontal, establishes an adequate communication link with aircraft 108. When the aircraft 108 is at position 110B at a horizontal distance from antenna 10, it is at an effective direct distance of D2 at an elevation angle of 122B. An antenna beam pattern 120B that has a higher signal strength that beam pattern 120A is required to maintain the same link margin with the aircraft 108. It can be seen by comparison of the beam patterns 120A, 120B that it is desirable to have a higher strength beam at lower elevation angles.

Table 1 below provides the additional gain required to maintain a certain link margin as the elevation is reduced from 90°.

TABLE 1

| Elevation | direct distance (multiple of D1 of FIG. 8) | extra antenna gain required to maintain link |
|---|---|---|
| 90° | 1.00 × D1 | 0.0 dB |
| 45° | 1.41 × D1 | 3.0 dB |
| 30° | 2.00 × D1 | 6.0 dB |
| 15° | 3.86 × D1 | 11.7 dB |

It can be seen from the extra gain required at elevation in the range of 15-30° that it is advantageous for the antenna 100 of FIG. 8 to have a higher gain at lower elevations.

Figure 9A:
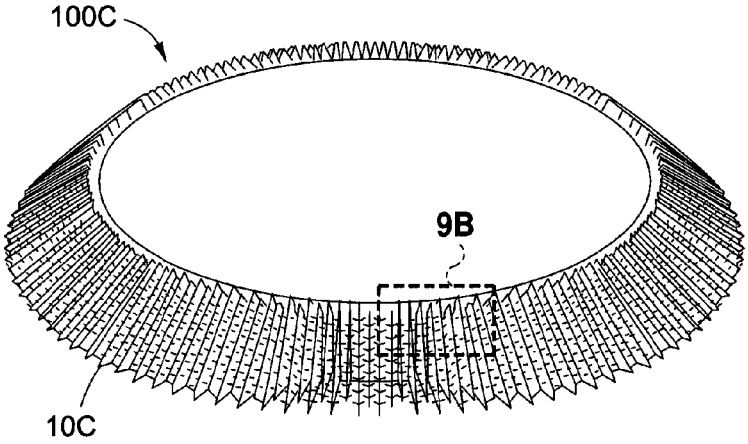
FIGS. 9A and 9B are prospective views of an exemplary conical antenna array according to certain aspects of the present disclosure.
Figure 9B:
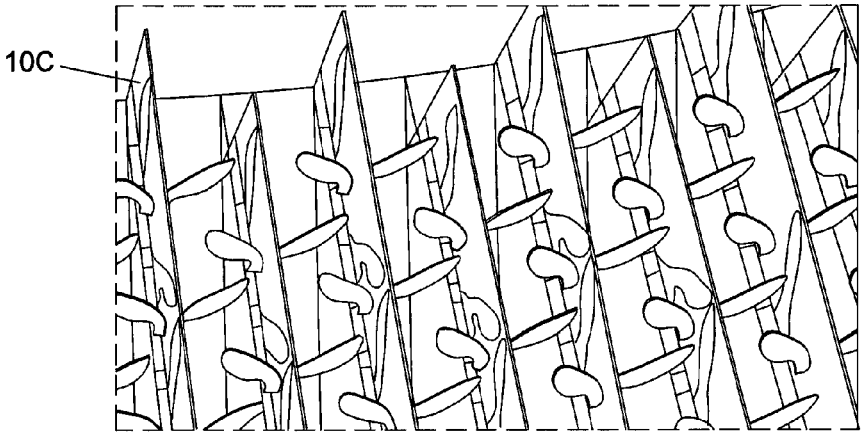

FIGS. 9A and 9B are prospective views of an exemplary conical antenna array 100C according to certain aspects of the present disclosure. The conical array 100C includes a plurality of antenna subarrays 10C positioned on the inclined surface of a truncated cone as shown in FIG. 9A. The dashed-line box in FIG. 9A indicates the area of the conical array 100C shown in FIG. 9B, wherein it can be seen that, in this embodiment, the subarrays 10C are arranged at an even spacing with alternating subarrays 10C offset from each other.

In certain embodiments, each of the subarrays 10C are connected independently to drive circuits such that the timing of the signals emitted by each subarray 10C can be time-shifted thereby steering the composite beam pattern. In certain embodiments, the subarrays 10C include circuit components, such as the electronic components 16 of FIG. 1A, that provide a portion of the time-shifting functionality.

Figure 10:
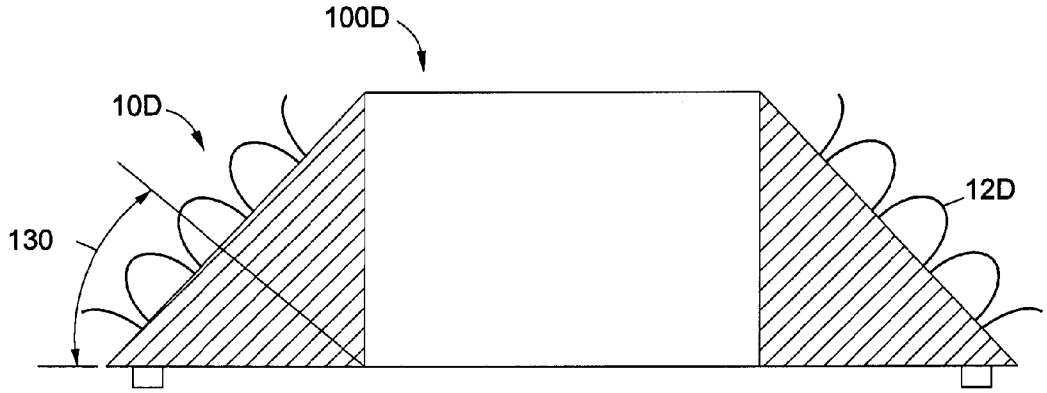
FIGS. 10-14 are cross-sections of additional embodiments of conical antenna arrays according to certain aspects of the present disclosure.

FIGS. 10-14 are cross-sections of additional embodiments 100D-100H of conical antenna arrays according to certain aspects of the present disclosure. FIG. 10 discloses a antenna array 100D wherein each of the subarrays 10D is composed of uniform antenna elements (not shown) with common individual beam patterns 12D at a uniform spacing. The subarrays 10D are arranged at an elevation 130 that, in this embodiment, is approximately 45° from the horizontal.

Figure 11:
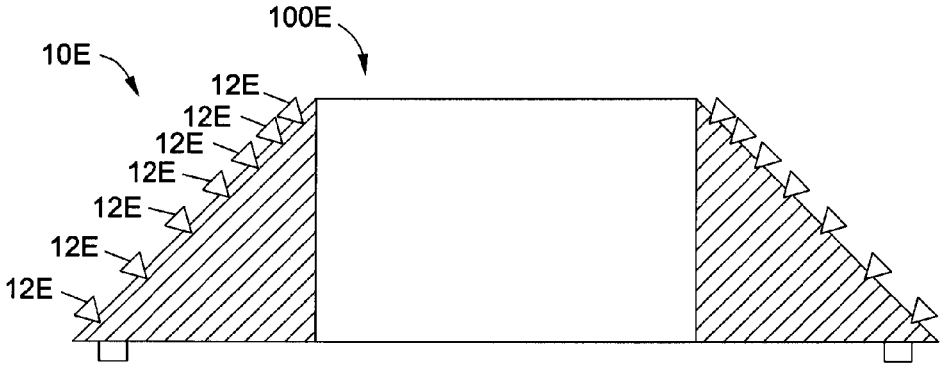

FIG. 11 depicts a conical array 100E composed of subarrays 10E comprising a single type of antenna element 12E with a variable spacing between the elements 12E. This may provide benefits in shaping the beam pattern and providing different signal strengths at different elevations.

Figure 12:
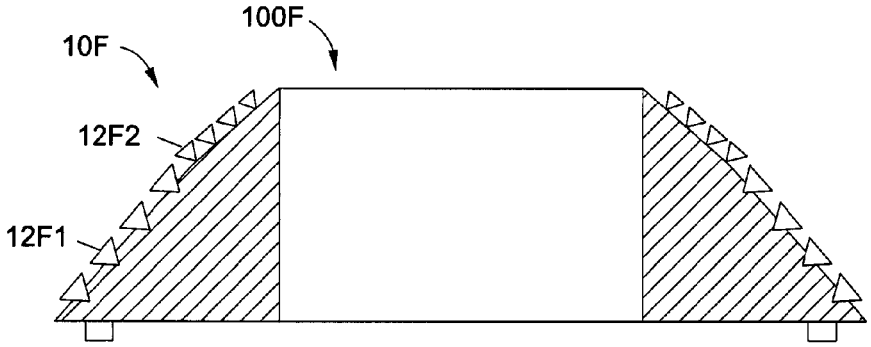

FIG. 12 depicts a conical array 100F wherein the subarrays 10F include two types of antenna elements 12F1 and 12F2. Each set of elements 12F1, 12F2 is grouped along a portion of the subarray 10F with a uniform spacing between each of the elements of the respective group. This may provide a benefit in shaping the beam pattern or tailoring the frequency coverage at different elevations.

Figure 13:
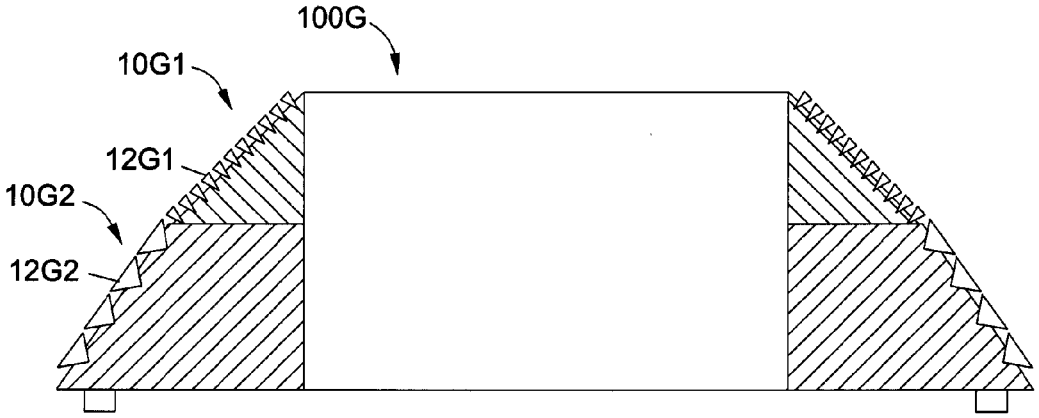

FIG. 13 depicts a stacked array 100G comprising two subarrays 10G1 and 10G2 arranged in a vertical stack. In this embodiment, the array 10G1 is built from antenna elements 12G1 mounted at a uniform spacing and array 10G2 is similarly formed from antenna elements 12G2 arranged with even spacing. In this embodiment the arrays 10G1 and 10G2 are not mounted at a common angle. In certain embodiments, the stacked array 100G can be treated as two independent arrays 100G1, 100G2 having different frequency ranges and different effective elevation angles. In certain embodiments, the stacked array 100G can be operated with cooperation between the antenna elements of arrays 10G1 and 10G2 to form a composite beam pattern of a particular sort.

Figure 14:
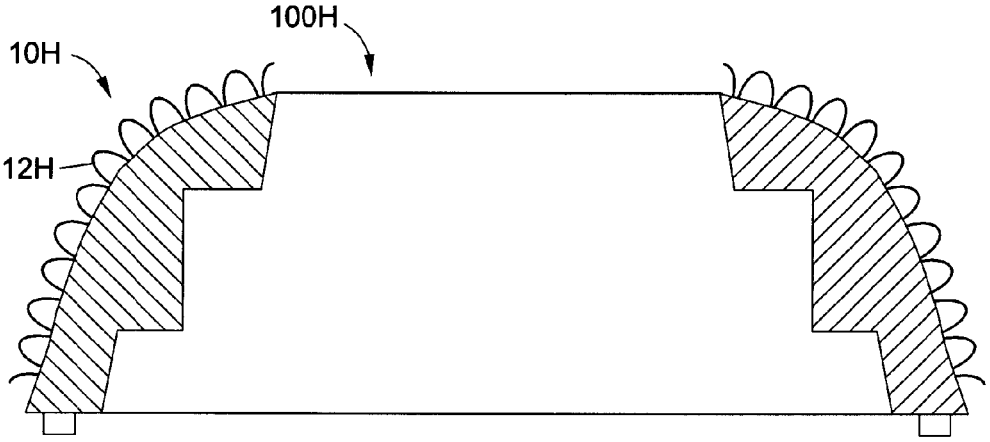

FIG. 14 depicts an antenna array 100H configured as a partial toroid according to certain aspects of the present disclosure. In this embodiment, the antenna subarrays 10H have curved profiles that form a portion of an ellipse with uniformly spaced antenna elements 12H. When a plurality of the subarrays 10H are positioned around a circular parameter, the composite profile of the subarrays 10H forms the partial toroid of the array 100H.

Figure 15:
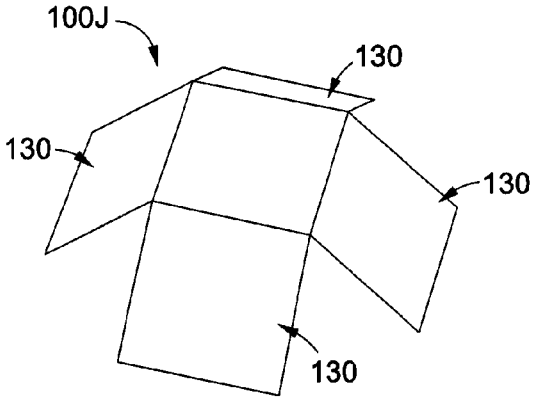
FIG. 15 depicts another embodiment of an antenna array according to certain aspects of the present disclosure.

FIG. 15 depicts another embodiment of an antenna array 100J according to certain aspects of the present disclosure. In this embodiment of array 100J, multiple planar arrays 130 are positioned around the edges of a square central region with a common elevation angle. The beam pattern of the individual planar arrays 130C will be similar to that of a single planar array, but the composite beam pattern may be adjusted by coordinated beam steering of each of the individual beams.

Figure 16:
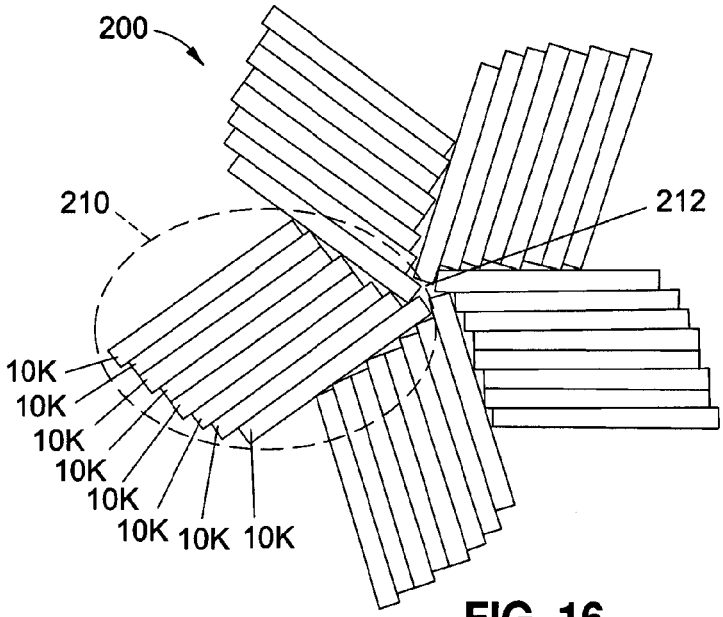
FIG. 16 depicts the arrangement of subarrays to form a five-fold symmetric sparse planar array according to certain aspects of the present disclosure.

FIG. 16 depicts the arrangement of subarrays to form a five-fold symmetric sparse planar array 200 according to certain aspects of the present disclosure. In this embodiment, each of the subarrays 10K is a dual circular polarization subarray. Groups of eight subarrays 10K are arranged in planar modules 210 wherein the subarrays 10K are arranged parallel with respect to each other with an offset between some of the subarrays 10K. To form the five-fold symmetric sparse array 200, five modules 210 are arranged in a pinwheel fashion above a central point 212 with the sets of subarrays 10K radiating generally outwards from the central point 212 as shown in FIG. 16. An array 200 may have little or no grating lobe and may also provide improved side lobe performance and a narrower beam for a given number of antenna elements.

Figure 17:
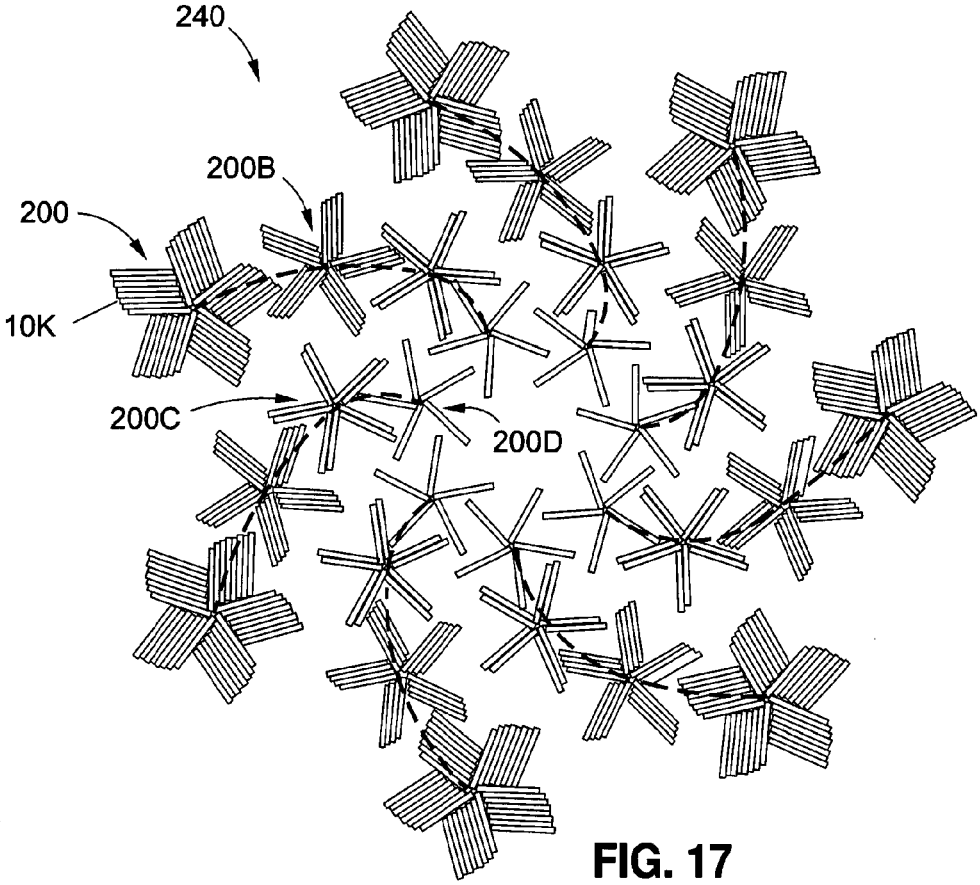
FIG. 17 depicts a seven-point asymmetric snowflake antenna array according to certain aspects of the present disclosure.

FIG. 17 depicts a seven-point asymmetric snowflake antenna array 240 according to certain aspects of the present disclosure. There is a outer ring of seven of the 5-fold sparse arrays 200 of FIG. 16, each having eight subarrays 10K arranged in five modules 210. There is a second ring of arrays 200B formed with the same five-fold symmetry but having only four subarrays 10K in each module 210. These second ring of arrays 200B are positioned with an offset to the angular positions of the arrays 200 in the first ring. There is a third ring of arrays 200C, again with five-fold symmetry but with only two subarrays 10K in each module 210. Similarly there is a fourth ring of arrays 200D having only a single subarray 10K in each module 210. In certain embodiments, this arrangement of arrays 200, 200B, 200C, and 200D may provide a composite beam pattern having a specific non-uniform shape. In certain embodiments, subsets of the arrays 200, 200B, 200C, and 200D are used independently to provide multiple beams. In certain embodiments, the subarrays of the various arrays are not identical.

Figure 18:
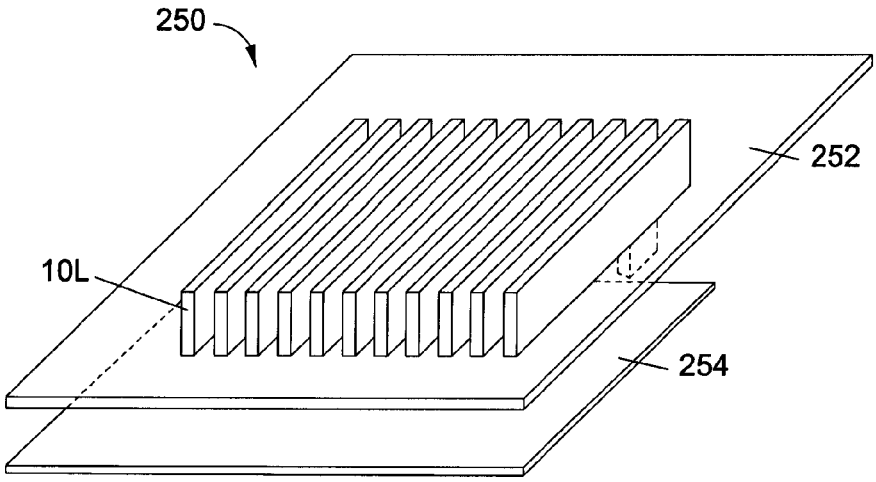
FIG. 18 depicts an exemplary construction of an antenna array according to certain aspects of the present disclosure.

FIG. 18 depicts an exemplary construction of an antenna array 250 according to certain aspects of the present disclosure. In this embodiment, subarrays are provided as connectorized line replaceable units (LRUs) 10L. In this embodiment, the LRUs 10L are mounted to a power and structural support 252 with a portion of each LRU passing through the support 252 to connect to a second printed circuit board 254 comprising beam forming circuit elements.

Figure 19A:
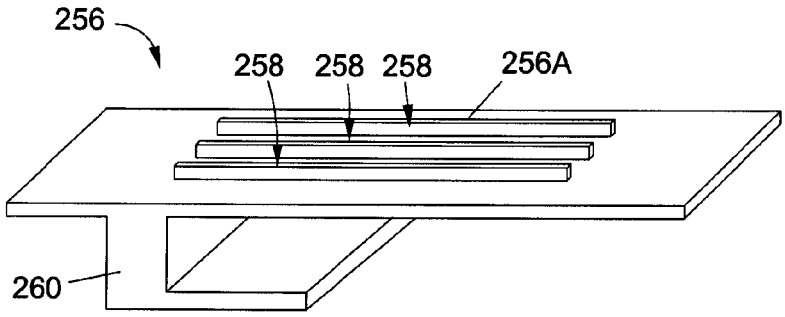
FIGS. 19A and 19B depict details of the construction of the antenna array of FIG. 18 according to certain aspects of the present disclosure.
Figure 19B:
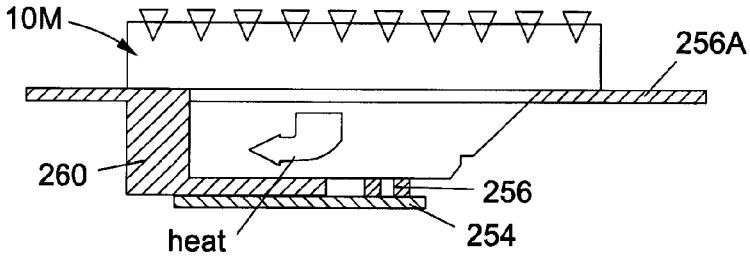

FIGS. 19A and 19B depict details of the construction of the antenna array 250 of FIG. 18 according to certain aspects of the present disclosure. FIG. 19A depicts the power and structural support 256 having slots 258 in the main portion 256A and a heat sink 260 coupled to the underside of the main portion 256A. FIG. 19B is a side view of the structural support 256 of FIG. 19A with a LRU 10L installed. It can be seen that the LRU 10L passes through a slot 258 and that a portion of the LRU 10L is in contact with the heat sink 260. The LRU 10L also mates with connectors 256 on the circuit board 254 that is mounted beneath the heat sink 260.

Figure 20:
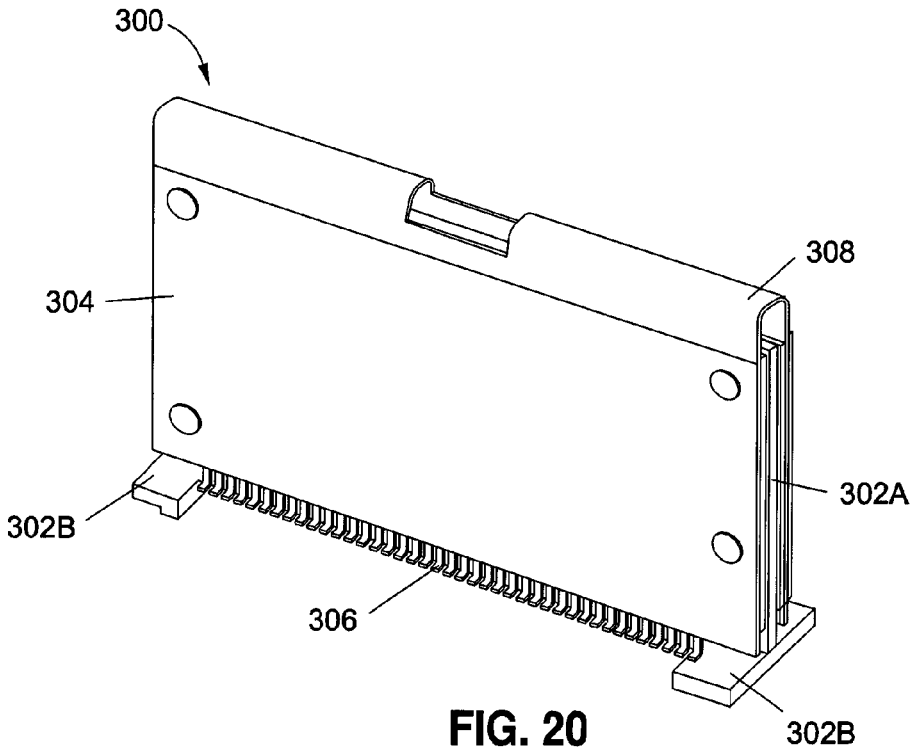
FIG. 20 is a perspective view of an electronics assembly adapted to mount circuit elements perpendicular to a main board according to certain aspects of the present disclosure.

FIG. 20 is a perspective view of an electronics assembly 300 adapted to mount circuit elements perpendicular to a main board (not shown) according to certain aspects of the present disclosure. A structural support 302, having a vertical portion 302A and attachment portions 302B, provides vertical structure to support the component assembly 300. Circuit assemblies 304 are mounted to each side of the vertical portion of structural support 302A with connections between the two circuit assemblies 304 provided by a flexible circuit element 308. In addition, the circuit assemblies 304 can be connected to circuit elements of the main board through surface mount technology (SMT) connector tabs 306 visible at the bottom edge of the visible circuit assembly 304.

Figure 21:
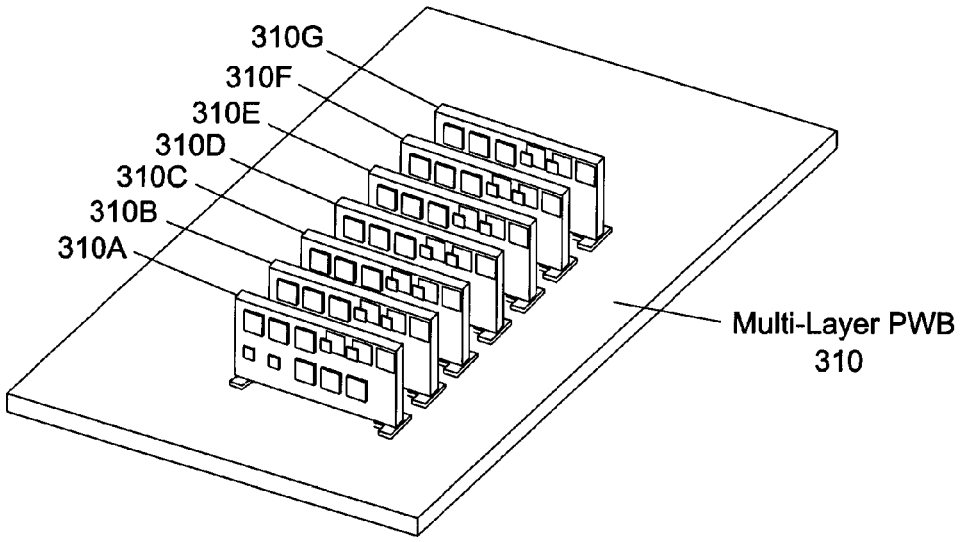
FIG. 21 depicts a plurality of component assemblies attached perpendicular to a main circuit board according to certain aspects of the present disclosure.

FIG. 21 depicts a plurality of component assemblies 300A-300G attached perpendicular to a main circuit board 310 according to certain aspects of the present disclosure. Each electronics assembly 300A-300G is attached separately through the respective structural supports 302 and interconnected through respective SMT connectors 306. This arrangement of electronics provides a much denser circuit assembly for a given area of main circuit board 310 compared to having all components mounted directly to the main circuit board 310.

Figure 22A:
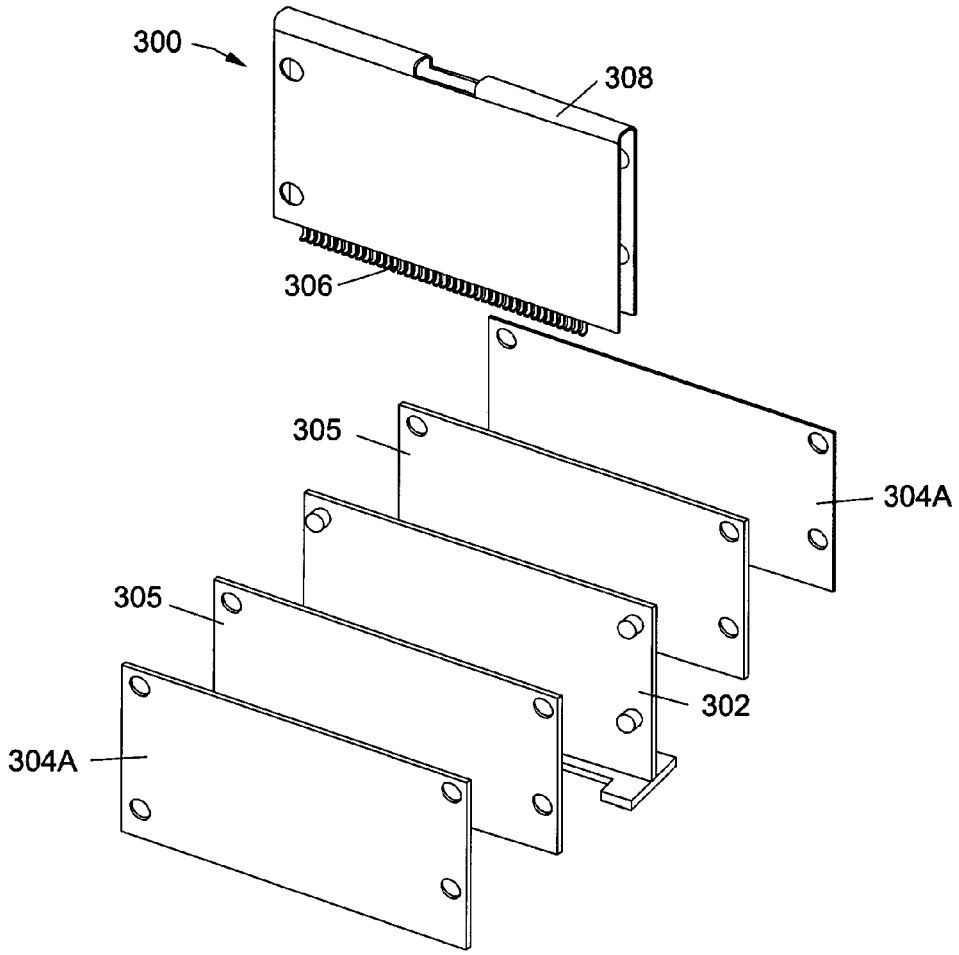
FIGS. 22A and 22B provide details on an exemplary construction of component assembly according to certain aspects of the present disclosure.
Figure 22B:
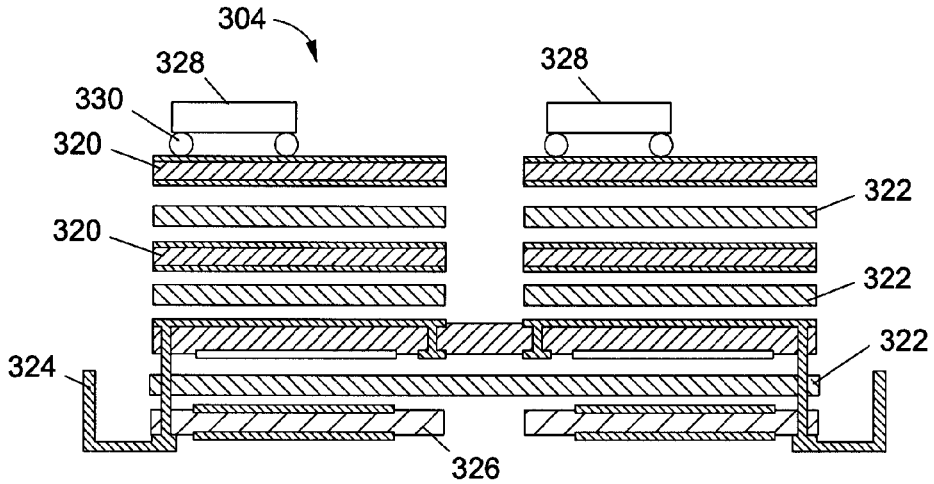

FIGS. 22A and 22B provide details on an exemplary construction of component assembly 300 according to certain aspects of the present disclosure. FIG. 22A is an exploded view of components assembly 300. It can be seen that the structural support 302 is a central element of this construction, with adhesive layers 305 positioned on each surface of the vertical portion 302A and circuit assemblies 304A, 304B attached to the respective layers of adhesive 305. In this embodiment, the flexible circuit element 308 provides both interconnection between circuit assemblies 304A, 304B as well as connection of the circuit assemblies 304A, 304B to the main circuit board 310 (not show in FIG. 22A).

FIG. 22B is a cross section of an exemplary circuit assembly 304. The circuit assembly 304 includes a leadframe 324 coupled to one of the layers of double copper-clad laminate 320, such as Rogers Ultralam® 3850, that has been etched to provide circuit elements. Layers of an adhesive sheet 322, such as Rogers Ultralam® 3908, are interleaved between the layers of laminate 320 to form a multilayer circuit assembly. In this embodiment, the circuit elements of the multiple laminates 320 are interconnected through vias that are not shown in FIG. 22B. A structural layer 326, such as Rogers RO4350B™, is provided on one side to provide rigidity and handling capability for the subassembly. Electronic devices 328, such as active devices, passive devices and/or microcomputer elements, are attached to the surface layer of laminate 320 through solder 330.

The concepts disclosed herein provides a antenna array having a higher gain at low elevations compared to the gain of the same antenna at a 90° elevation. In addition, the antenna is composed of subarrays that can be individually controlled to steer the composite beam of the array. Each subarray is constructed using proven SMT manufacturing methods that may provide improved reliability as well as simplified construction of the array. A method of constructing a subarray is also disclosed.

The previous description is provided to enable a person of ordinary skill in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the terms "a set" and "some" refer to one or more. Pronouns in the masculine (e.g., his) include the feminine and neuter gender (e.g., her and its) and vice versa. Headings and subheadings, if any, are used for convenience only and do not limit the invention.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

The word "reflect" as used herein refers to a redirection of a beam of light that is incident upon a surface of a reflecting object such that the light does not pass through the reflecting object. It is known to those of skill in the art that there is some loss of energy in the reflecting process and that the total energy of the reflected light is lower than the total energy of the incident light beam.

The term "optical" covers electromagnetic radiation from ultraviolet to infrared, including wavelengths in the range of 10 nanometers to 1 millimeter and includes, but is not limited to, light visible to the human eye, which covers the range of 380-760 nanometers.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Designation of a particular surface, for example a front surface of a mirror, defines the local frame of reference, for example the regions that are in front of and behind the mirror, to be consistent with this designation.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An antenna subarray comprising:

a main board comprising:

a first substrate having a first side, a second side opposite the first side, and a plurality of slots on the first and second sides;

a patterned conductive layer coupled to the first substrate; and a first conductive antenna element coupled to the first substrate; and a plurality of ancillary boards, each of the plurality of ancillary boards comprising:

a second substrate having a locating tab extending from a proximal edge of the second substrate, wherein the locating tab is coupled with a respective one of the plurality of slots such that the proximal edge of the second substrate is mounted on one of the first side or the second side of the first substrate with the second substrate extending outward from the one of the first side or the second side of the first substrate and a distal edge of the second substrate being unmounted; and a second conductive antenna element coupled to the second substrate and through a soldered connection to the patterned conductive layer of the main board, wherein a longest dimension of the first substrate is greater than a longest dimension of the second substrate.

2. The antenna subarray of claim 1, wherein the patterned conductive layer comprises a signal circuit formed as a first patterned conductive layer on the first substrate and a ground circuit formed as a second patterned conductive layer on the first substrate.

3. The antenna subarray of claim 2, wherein the second conductive antenna element is formed as a patterned conductive layer on the second substrate and coupled through a soldered connection to one of the signal circuit and the ground circuit.

4. The antenna subarray of claim 2, wherein the first conductive antenna element is formed as a third patterned conductive layer on the first substrate, wherein the first patterned conductive layer, the second patterned conductive layer, and the third patterned conductive layer are separated by nonconductive layers.

5. The antenna sub array of claim 4, wherein:

the first conductive antenna element comprises at least one first radiating element electrically coupled to the signal circuit and at least one second radiating element electrically coupled to the ground; and the first and second radiating elements are formed on different patterned conductive layers of the first substrate.

6. The antenna subarray of claim 5, wherein:

the second conductive antenna element comprises at least one third radiating element electrically coupled to the signal circuit and at least one fourth radiating element electrically coupled to the ground; and the third and fourth radiating elements are formed on different patterned conductive layers of the second substrate.

7. The antenna subarray of claim 6, wherein the first and second radiating elements are arranged to cooperatively form a balanced antipodal Vivaldi antenna (BAVA); and the third and fourth radiating elements are arranged to cooperatively form a BAVA.

8. The antenna subarray of claim 1, further comprising a third conductive antenna element, wherein the second substrate comprises a first side and a second side opposite the first side, wherein the second conductive antenna element is on the first side of the second substrate, wherein the third conductive antenna element is on the second side of the second substrate.

9. A method of forming an antenna subarray, the method comprising the step of:

providing a first printed circuit board assembly (PCBA) having a first side, a second side opposite the first side, and a plurality of slots on the first and second sides;

providing a plurality of second printed circuit board assembly assemblies (PCBAs), each of the plurality of second PCBAs having a locating tab extending from a proximal edge of the PCBA;

coupling the plurality of second PCBAs to the first PCBA by coupling the locating tab of each of the plurality of second PCBAs with a respective one of the plurality of slots such that the proximal edge of each of the plurality of second PCBAs is mounted on one of the first side or the second side of the first PCBA with the plurality of second PCBAs extending outward from the one of the first side or the second side of first PCBA and a distal edge of each of the plurality of second PCBAs being unmounted; and soldering a first patterned conductive layer to a second patterned conductive layer, wherein the first patterned conductive layer is formed on the first PCBA, wherein the first patterned conductive layer is electrically coupled to a conductive antenna element formed on the first PCBA, wherein the second patterned conductive layer is formed on the plurality of second PCBAs, and wherein the second patterned conductive layer is coupled to one of a signal source or a ground, wherein a longest dimension of the first PCBA is greater than a longest dimension of the each of the plurality of second PCBAs.

10. The method of claim 9, wherein the soldering is accomplished by a reflow process.

11. An antenna subarray comprising:

a first printed circuit board assembly (PCBA) comprising:

a first nonconductive substrate having a first side, a second side opposite the first side, and a plurality of slots on the first and second sides, a signal circuit formed on the first nonconductive substrate;

a ground formed on the first nonconductive substrate;

a plurality of first conductive radiating elements formed on the first nonconductive substrate and electrically coupled to the signal circuit; and a plurality of second conductive radiating elements formed on the first nonconductive substrate and electrically coupled to the ground; and a plurality of second printed circuit board assemblies (PCBAs) each of the plurality of second PCBAs comprising:

a second nonconductive substrate having a locating tab extending from a proximal edge of the second substrate, wherein the locating tab is coupled with a respective one of the plurality of slots such that the proximal edge of the second substrate is mounted on one of the first side or the second side of the first substrate with the second substrate extending outward from the one of the first side or the second side of the first substrate and a distal edge of the second substrate being unmounted;

a plurality of third conductive radiating elements formed on the second nonconductive substrate and electrically coupled by soldering to the signal circuit; and a plurality of fourth conductive radiating elements formed on the second nonconductive substrate and electrically coupled by soldering to the ground, wherein a longest length of the second nonconductive substrate is less than a longest length of the first nonconductive substrate.

12. An antenna array comprising:

a plurality of antenna subarrays each comprising:

a first printed circuit board assembly (PCBA) comprising:

a first nonconductive substrate having a first side, a second side opposite the first side, and a plurality of slots on the first and second sides;

a signal circuit formed on the first substrate;

a ground formed on the first substrate;

a plurality of first conductive radiating elements formed on the first substrate and electrically coupled to the signal circuit; and a plurality of second conductive radiating elements formed on the first substrate and electrically coupled to the ground; and a plurality of second printed circuit board assemblies (PCBAs), each of the plurality of second PCBAs comprising:

a second nonconductive substrate having a locating tab extending from a proximal edge of the second substrate, wherein the locating tab is coupled with a respective one of the plurality of slots such that the proximal edge of the second substrate is mounted on one of the first side or the second side of the first substrate with the second substrate extending outward from the one of the first side or the second side of the first substrate and a distal edge of the second substrate being unmounted;

a plurality of third conductive radiating elements formed on the second substrate and electrically coupled by soldering to the signal circuit; and a plurality of fourth conductive radiating elements formed on the second substrate and electrically coupled by soldering to the ground, wherein a longest length of the second substrate is less than a longest length of the respective first substrate.

13. The antenna array of claim 12, wherein the plurality of antenna subarrays are disposed in a symmetric pattern extending radially from a center axis at a common elevation angle from a plane perpendicular to the center axis.

14. The antenna array of claim 13, wherein the plurality of antenna subarrays each comprise radiating elements arranged to operate over different frequency ranges.

15. The antenna array of claim 13, further comprising support elements configured to provide mechanical support to the antenna subarrays, the support elements comprising electrical circuits coupled to the antenna subarrays.

16. The antenna array of claim 12, wherein the plurality of antenna subarrays are disposed in a symmetric pattern in a plane radiating outward from a center.

17. The antenna array of claim 14, wherein the plurality of antenna subarrays are disposed in groups of adjoining parallel antenna subarrays with one of each group radiating outward from the center.

18. The antenna array of claim 12, wherein:

the antenna array further comprises a control unit;

the plurality of antenna subarrays are electrically coupled to the control unit; and the control unit is configured to control the timing of the signals provided to the antenna subarrays so as to steer a composite signal radiated from the antenna array.

* * * * *